United States Patent [19]

Morrison et al.

[11] Patent Number: 4,559,468

[45] Date of Patent: Dec. 17, 1985

[54] CATHODE RAY TUBE GUN SUPPORT

[75] Inventors: Raymond C. Morrison, Scituate, Mass.; Paul H. Gleichauf, deceased, late of Scituate, Mass.; Theresa C. Gleichauf, executrix, Pittsburgh, Pa.

[73] Assignee: Raytheon Company, Lexington, Mass.

[21] Appl. No.: 392,400

[22] Filed: Jun. 25, 1982

[51] Int. Cl.[4] ..... H01J 29/82

[52] U.S. Cl. ..... 313/456; 313/451; 313/417

[58] Field of Search ..... 313/243, 256, 417, 438, 313/451, 456, 457, 482, 251, 285, 356, 414

[56] References Cited

U.S. PATENT DOCUMENTS

| | | | |
|---|---|---|---|
| 2,800,603 | 7/1957 | Bryant et al. | 313/256 X |
| 2,939,980 | 6/1960 | Dickinson et al. | 313/467 |
| 3,027,479 | 3/1962 | Benway | 313/82 |
| 3,145,318 | 8/1964 | Paull | 313/82 |
| 3,394,279 | 7/1968 | Yorns et al. | 313/82 |
| 3,484,641 | 12/1969 | Drees | 313/251 |
| 4,032,811 | 6/1977 | Schwartz et al. | 313/417 |
| 4,049,991 | 9/1977 | Collins | 313/417 |
| 4,082,977 | 4/1978 | Blumenberg | 313/457 |
| 4,258,284 | 3/1981 | Month et al. | 313/456 X |

*Primary Examiner*—David K. Moore
*Assistant Examiner*—K. Wieder
*Attorney, Agent, or Firm*—John T. Meaney; R. M. Sharkansky

[57] ABSTRACT

An electron gun for a cathode ray type tube and comprising a coaxially aligned series of tubular electrodes insulatingly connected to one another to form a sub-assembly and an axially spaced glass stem having sealed through it an array of electrical terminal pins, at least one of the electrodes being electrically connected to a terminal pin through a hollow tubular conductor having crimped portions which permit misalignment of the stem with respect to the gun while supporting said sub-assembly of electrodes axially and anti-rotationally with respect to said terminal pins extending from the stem.

12 Claims, 8 Drawing Figures

CATHODE RAY TUBE GUN SUPPORT

BACKGROUND OF THE INVENTION

1. Field of the Invention

This invention relates generally to electron guns and is concerned more particularly with an electron gun supported within an electron tube envelope.

2. Discussion of the Prior Art

An electron tube of the cathode ray type may comprise a generally funnel-shaped envelope provided with a neck-end portion wherein an electron gun is axially disposed for directing an electron beam onto an anode target in the larger diameter end portion of the envelope. Terminating the neck-end portion of the envelope is a peripherally sealed glass disc or stem press through which extends a sealed array of electrical terminal pins. The terminal pins are connected electrically to electrodes of the gun including an electron-emitting cathode adjacent the stem press and a coaxial series of beam-forming electrodes.

The beam-forming electrodes may be provided with respective apertures which are axially aligned with one another for permitting passage of electrons in the beam and for focussing the beam onto a small circular spot area of the anode target. To aid in maintaining these apertures in the axial alignment, the beam-forming electrodes may be insulatingly attached to one another, as by axially extending dielectric rods, for example, to form a sub-assembly which is mounted on the stem press in alignment with the cathode.

In assembly, after the cathode and beam-forming electrodes are mounted on the terminal pins of the stem press, the beam-forming electrode most remote from the stem press is inserted into the neck-end portion and the stem press is urged axially to slide the gun into the neck-end portion. Consequently, the beam-forming electrode most remote from the stem press generally is provided with one or more radially projecting members which slidingly engage the inner surface of the neck-end portion to position the apertures in the electrodes of the sub-assembly substantially on the axial centerline of the tube. The beam-forming electrode nearest the stem press is fixedly attached in a relatively rigid manner to a plurality of terminal pins in the stem press and aids in sliding the gun axially within the neck-end portion as well as supporting the gun in axial spaced relationship with the stem press when installed in the neck-end portion.

However, it may be found that when the stem press is peripherally sealed to the encircling rim of the neck-end portion, it is very difficult to hold the stem press on the axial centerline of the tube. Due to the softening of the glass adjacent the periphery of the stem press during sealing, the stem press tends to move laterally or rotationally thereby exerting a corresponding radial pressure on the beam-forming electrode nearest the stem press. As a result, the apertures in the beam-forming electrodes adjacent the stem press are pulled out of axial alignment with the apertures in the beam-forming electrodes adjacent the opposing end of the sub-assembly. Thus, electrons passing through the apertures in the beam-forming electrodes adjacent the stem press may not pass through the apertures in beam-forming electrodes adjacent the opposing end of the gun. Consequently, the electron current of the beam may be unacceptably low; and the beam may be focussed onto an elliptical or a crescent-shaped area of the anode target.

SUMMARY OF THE INVENTION

Accordingly, these and other disadvantages of the prior art are overcome by this invention providing an electron gun with an axially rigid and transversely yieldable support means for attaching the gun to a support structure which may move laterally of the gun. Thus, the support means provides the rigidity necessary for maintaining the gun axially and anti-rotationally with respect to the support structure. Also, the support means provides the transverse yieldability required to compensate for lateral movement of the support structure without exerting a corresponding lateral pressure on the gun.

The electron gun comprises an electron-emitting cathode disposed adjacent one end of the gun and an axially aligned series of beam-forming electrodes which may be insulatingly attached to one another in a sub-assembly of the gun. The support means comprises a hollow tubular conductor which has a high strength to low mass ratio and which does not add appreciably to the inertia of the gun when undergoing mechanical shock and vibration. Axially spaced portions of the tubular conductor, such as opposing end portions thereof, for example, are disposed for attachment to a beam-forming electrode of the gun and to the support structure, respectively.

Between the attached portions, the tubular conductor is provided with at least one flexible portion, such as a transversely disposed crimp in the conductor, for example, where bending without breaking occurs when a laterally directed force is exerted on an attached portion of the conductor. Thus, when the attached support structure moves laterally of the conductor, the conductor flexes or bends at the transversely crimped portion to permit the attached portion of the conductor to follow the support structure. However, since the resulting lateral pressure is transmitted only as far as the crimped portion, the portion of the conductor attached to the beam-forming electrode does not exert a corresponding lateral pressure on the gun.

BRIEF DESCRIPTION OF THE DRAWING

For a more complete understanding of this invention, reference is made in the following detailed description to the accompanying drawing wherein.

DESCRIPTION OF THE PREFERRED EMBODIMENTS

Figure 1:
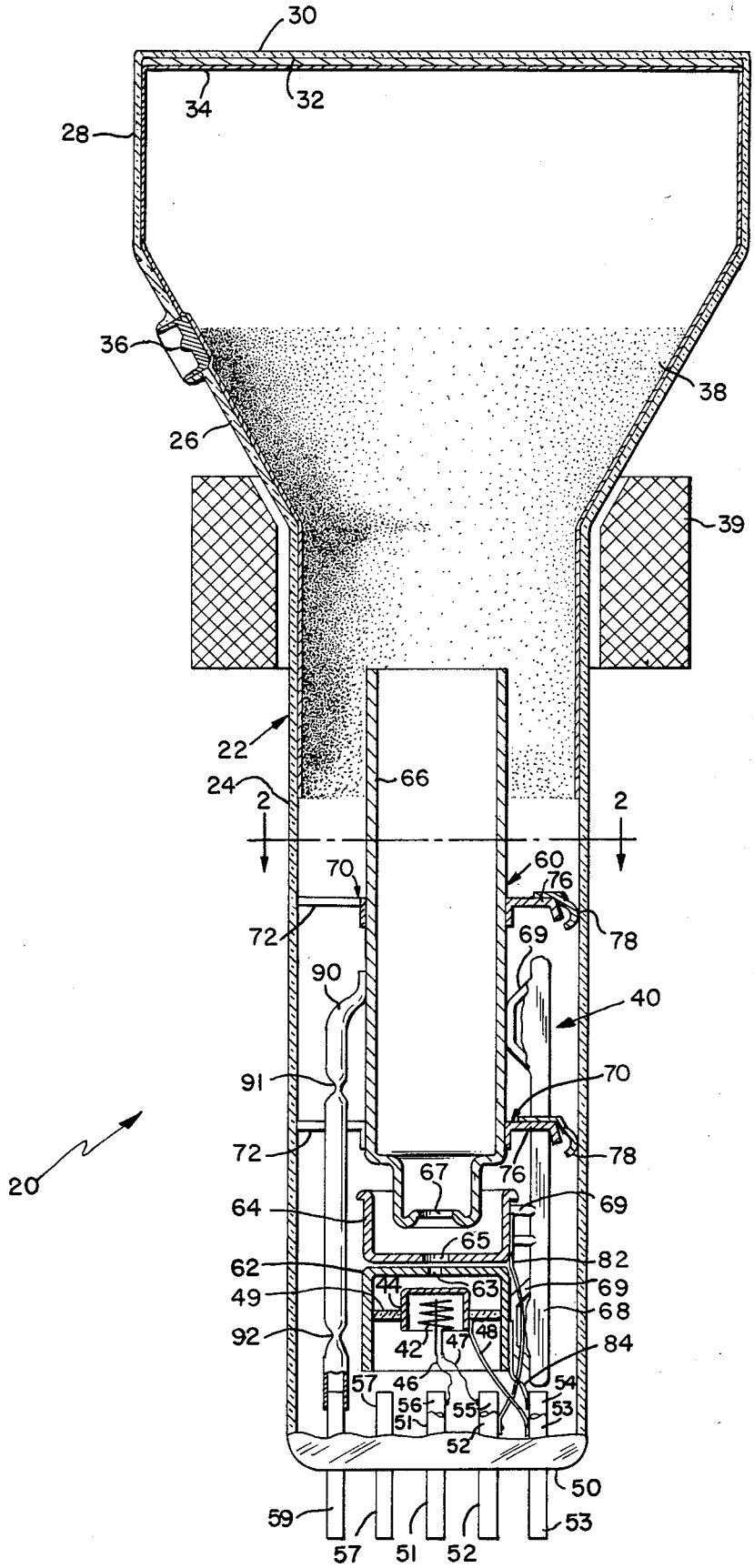
FIG. 1 is an axial view, partly in section, of a cathode ray type of electron tube embodying the invention.

Referring to the drawings wherein like characters of reference designate like parts, there is shown in FIG. 1 an electron tube 20 of the cathode ray type having an evacuated envelope 22 which is generally funnel-shaped and made of dielectric material, such as glass, for example. Envelope 22 includes a neck-end portion 24 which is integrally joined through an intermediate flared portion 26 to an opposing end portion 28 of larger diameter. The larger diameter end portion 28 terminates at one end of tube 20 in a transversely disposed output viewing faceplate 30 made of suitable transparent material, such as the glass material of envelope 22, for example. Faceplate 30 has disposed on its inner surface an anode target comprising an imaging screen layer 32 made of fluorescent material, such as zinc sulfide, for example. The layer 32 fluoresces locally when a discrete region thereof is penetrated by electrons beamed from an electron gun 40 axially disposed in the neck-end portion 24 of envelope 22.

Deposited by well-known means on the inner surface of layer 32 is a light reflective coating 34 of electrically conductive material, such as aluminum, for example, which is sufficiently thin to be substantially transparent to the beamed electrons. The coating 34 extends annularly onto an axially disposed inner surface of end portion 28 and onto the sloped inner surface of intermediate flared portion 26. Extending hermetically through the wall of intermediate flared portion 26 is an anode terminal button 36 whereby an anode potential is applied to the anode electrode of tube 20. The button 36 is electrically connected to the coating 34 and to a coating 38 of another electrically conductive material, such as carbon, for example. The coating 38 extends annularly along the sloped inner surface of intermediate flared portion 26 and into neck-end portion 24 a suitable distance for insulatingly encircling an exit end portion of the electron gun 40. As a result, electrons in a beam emanating from the exit end of gun 40 enter a substantially field-free space within the cup-shaped anode electrode formed by the respective coatings 34 and 38 electrically connected to the terminal button 36. Accordingly, the beamed electrons are accelerated and focussed onto an aligned discrete area of imaging screen layer 32 where they penetrate into the underlying material and cause it to fluoresce locally.

The electron beam emanating from gun 40 and terminating on imaging screen layer 32 may be deflected angularly with respect to the axial centerline of tube 20 by appropriate means, such as a conventional deflection yoke 39 disposed externally about a portion of envelope 22 adjacent the exit end of gun 40, for example. Thus, the electron beam may be scanned over successive discrete regions of the imaging screen layer causing them to fluoresce locally and produce a visible light image which is viewable through the output faceplate 30 in a well-known manner.

The neck-end portion 24 of envelope 22 terminates at the other end of tube 20 in a peripherally sealed glass disc or stem press 50 which has extending axially through it a sealed circular array of mutually spaced terminal pins, 51–59, respectively. Axially spaced from the inner end portions of pins 51–59 within neck-end portion 24 is an electron generating end portion of gun 40 comprising a filamentary heater 42 axially disposed within an inverted cathode cup 44. Opposing end portions of the heater 42 may be electrically connected to respective terminal pins 55 and 56 through flexible wire conductors, 46 and 47, respectively, which have sufficient rigidity to support the heater 42 within the cathode cup 44. Cathode cup 44 may be electrically connected to terminal pin 53 through a flexible wire conductor 48, and is supported in spaced insulating relationship within an inverted first grid cup 62 by an interposed annulus 49 of dielectric material, such as ceramic, for example. The closed end of cathode cup 44 is disposed in juxtaposed spaced relationship with the closed end of first grid cup 62 and is provided with an exterior coating (not shown) of electron emissive material, such as oxides of barium and strontum, for example. The coated end surface of cathode cup 46 is disposed for directing emitted electrons through an aligned aperture 63 which is centrally disposed in the closed end of first grid cup 62.

The closed end of first grid cup 62 is disposed in close spaced, juxtaposed relationship with a closed end of an upright second grid cup 64. Centrally disposed in the closed end of second grid cup 64 is an aperture 65 which is slightly larger in diameter than the aperture 63 and is axially aligned with it. The opposing open end portion of second grid cup 64 has insulatingly extended within it a reduced diameter, closed end portion of an elongated, third cup-like focussing electrode 66. The closed end of this third cup-like electrode 66 has centrally disposed in it an aperture 67 which is slightly larger in diameter than the aperture 65 and is axially aligned with it as well as with the aperture 63. All of the apertures 63, 65 and 67, have respective circular configurations and are axially aligned with one another for permitting passage of properly directed electrons which are formed into a beam by the electrodes 62, 64 and 66, respectively. In cooperation with the anode electrode comprised of respective coatings 34 and 38, the gun electrodes 62, 64 and 66 also serve to focus the electron beam onto a small circular spot area of the imaging screen layer 32. Thus, it is important that the gun electrodes 62, 64 and 66 be supported substantially on the axial centerline of neck-end portion 24 and have their respective apertures 63, 65 and 67 maintained in axial alignment with one another.

Figure 2:
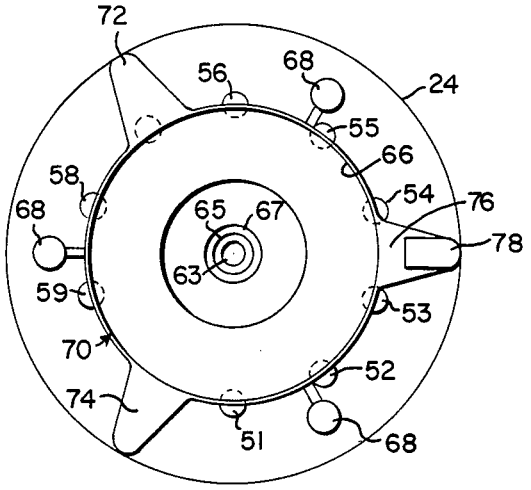
FIG. 2 is a cross-sectional view taken along the line 2—2 in FIG. 1 and looking in the direction of the arrows.

Accordingly, the respective elements 62, 64, and 66 of gun 40 constitute an axially extending series of beam-forming electrodes which may be insulatingly attached to one another in a sub-assembly 60 prior to mounting on the stem press 50. This objective may be achieved by disposing the series of beam-forming electrodes 62, 64 and 66 within an axially extending array of angularly spaced posts 68 made of rigid dielectric material, such as borosilicate glass, for example. As shown in FIG. 2, the array may comprise three posts 68 spaced substantially equiangular distances apart, such as one hundred and twenty degrees, for example, about the axial centerline of the sub-assembly. Each of the posts 68 may have embedded therein leg end portions of respective C-shaped brackets 69, having projecting bight portions attached, as by welding, for example, to adjacent wall portions of a respective coplanar one of the beam-forming electrodes 62, 64 and 66 of the series. The brackets 69 are made of rigid material, such as nonmagnetic stainless steel, for example, and support the attached beam-forming electrodes 62, 64 and 66 of the sub-assembly 60 in fixed positional relationship with one another as well as maintaining the respective apertures 63, 65 and 67 in axial alignment with one another.

The beam-forming sub-assembly 60 may be supported transversely within the neck-end portion 24 by a plurality of axially spaced rings 70 made of suitable rigid material, such as non-magnetic stainless steel, for example. The rings 70 encircle at least one of the beam-forming electrodes, such as the third electrode 66, for example, and have respective inner peripheral collar portions attached, as by welding or brazing, for examples to the outer cylindrical surface of electrode 66. As shown more clearly in FIG. 2, each of the rings 70 is provided with a plurality of radially extending projections, such as 72, 74 and 76, respectively, for example, which may be spaced symmetrically apart about the axial centerline of attached electrode 66. In the radial direction, each of the respective projections 72, 74 and 76 extends between two of the dielectric posts 68 and has a generally triangular configuration which terminates in a rounded apex or tip adjacent the inner surface of neck-end portion 24. Projection 76 has a resilient tip 78 comprised of a thin strip of stainless steel welded to the rigid portion of projection 76 and provided with a resiliently yielding curvature in the axial direction for pressingly engaging the inner surface of neck-end portion 24. The other projections 72 and 74 have respective rigid tips which are pressed into firm radial contact with the inner surface of neck-end portion 24 as a result of the pressure exerted by resilient tip 78 against the inner surface of portion 24.

The neck-end portion 24 of the glass envelope 22 has a radius which is substantially equal to the radial extent of projections 72 and 74 as measured from the axial centerline of attached electrode 66. Accordingly, the projections 72 and 74 having their respective rigid tips pressed into firm radial contact with the inner surface of neck-end portion 24 position the axial centerline of electrode 66 substantially on the axial centerline of neck-end portion 24. As a result, an electron beam emanating from the open end of electrode 66 comprising the exit end portion of gun 40 travels substantially along the axial centerline of neck-end portion 24 and the anode coating 38. In this manner, an electron beam generated in gun 24 is maintained substantially symmetrical with respect to the axial centerline of the electrostatic lense system of tube 20.

Figure 4:
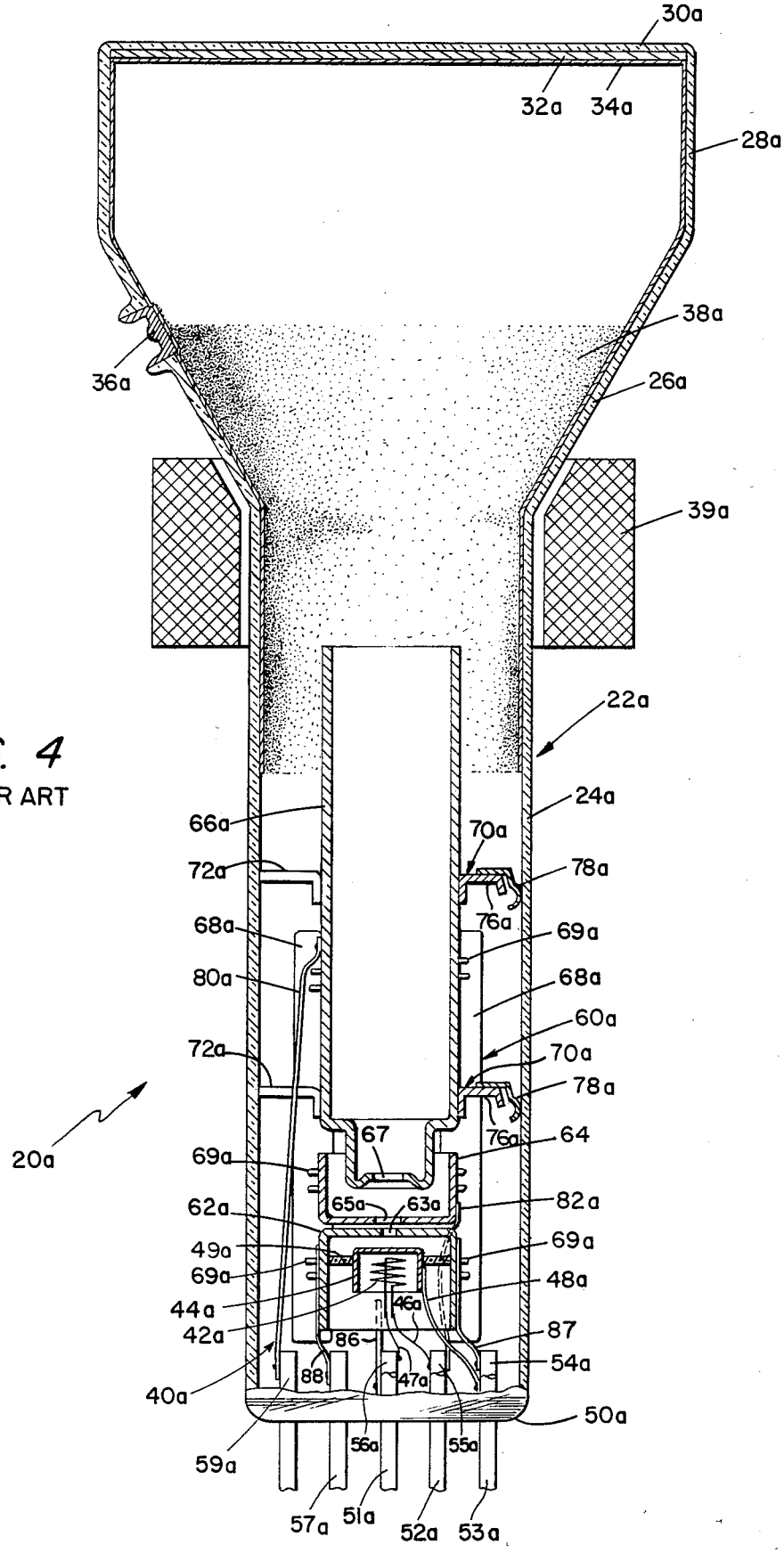
FIG. 4 PRIOR ART
FIG. 4 is an axial view, partly in section, of a prior art tube similar to the cathode ray type of electron tube shown in FIG. 1.
Figure 5:
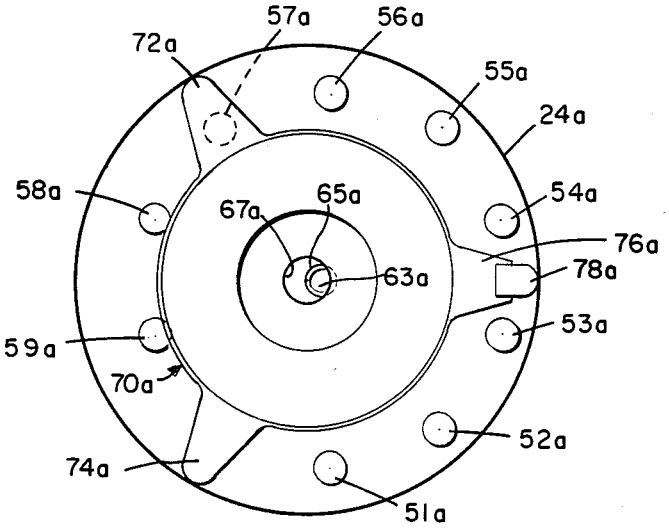
FIG. 5 PRIOR ART
FIG. 5 is a cross-sectional view of the electron gun shown in FIG. 4 but illustrating a disadvantageous aspect of this prior art tube.

In FIGS. 4 and 5, there is shown a similar cathode ray type tube 20*a* of the prior art having like parts designated by like characters of reference followed by the letter "a". Thus, tube 20*a* includes a generally funnel-shaped envelope 22*a* having a neck-end portion 24*a* wherein an electron gun 40*a* is axially disposed for directing an electron beam into a cup-shaped anode electrode comprised of coatings 34*a*, 38*a* and onto an anode target comprised of imaging screen layer 32*a*. The gun 40*a* includes an axially extending series of beam-forming electrodes 62*a*, 64*a* and 66*a* which are insulatingly connected to one another in a sub-assembly 60*a* by means of an axially extending array of angularly spaced posts 68*a* and attached brackets 69*a*. Sub-assembly 60*a* is transversely supported within neck-end portion 24*a* by two axially spaced rings 70*a* having respective inner collar portions attached to the electrode 66*a* and respective radial projections 72*a*, 74*a* and 76*a* pressingly engaging the inner surface of neck-end portion 24*a*.

During assembly, the second and third beam-forming electrodes 64*a* and 66*a* of sub-assembly 60*a* are electrically connected to respective terminal pins 57*a* and 59*a* through flexible wire conductors 81 and 83, respectively. However, the first beam-forming electrode 62*a* is electrically connected to respective angularly spaced terminal pins 51*a*, 54*a* and 57*a* through rigid strap-like conductors 86, 87 and 88, respectively. These strap-like conductors 86, 87 and 88 are required to provide sufficient rigidity for supporting the entire sub-assembly 60*a* in axial spaced relationship with the stem press 42*a*. Therefore, to enhance rigidity, the conductors 86, 87 and 88 may be attached, as by welding, for example, to the electrode 62*a* along the entire axial length thereof; and the axial space between electrode 62*a* and the attached terminal pins 51*a*, 54*a* and 57*a*, respectively, is minimized. As a further alternative (not shown), the respective terminal pins 51*a*, 54*a* and 57*a* may be provided with sufficient lengths for attaching, as by welding, for example, directly to the first grid electrode 62*a*.

After assembly of the gun 40*a* to the stem press 42*a*, the exit end portion of third beam-forming electrode 66*a* is inserted into the neck-end portion 24*a* and the stem press 42*a* is urged axially. As a result the respective projections 72*a*, 74*a* and 76*a* of rings 70*a* slidingly engage the inner surface of neck-end portion 24*a*; and the rim of neck-end portion 24*a* is brought into encircling relationship with stem press 50*a*. Then, the glass adjacent the periphery of stem press 50*a* and the encircling rim of neck-end portion 24*a* is heated in a well-known manner for causing it to soften and fuse together thereby peripherally sealing the stem press 50*a* to close the neck-end portion 24*a* of envelope 22*a*.

Figure 6:
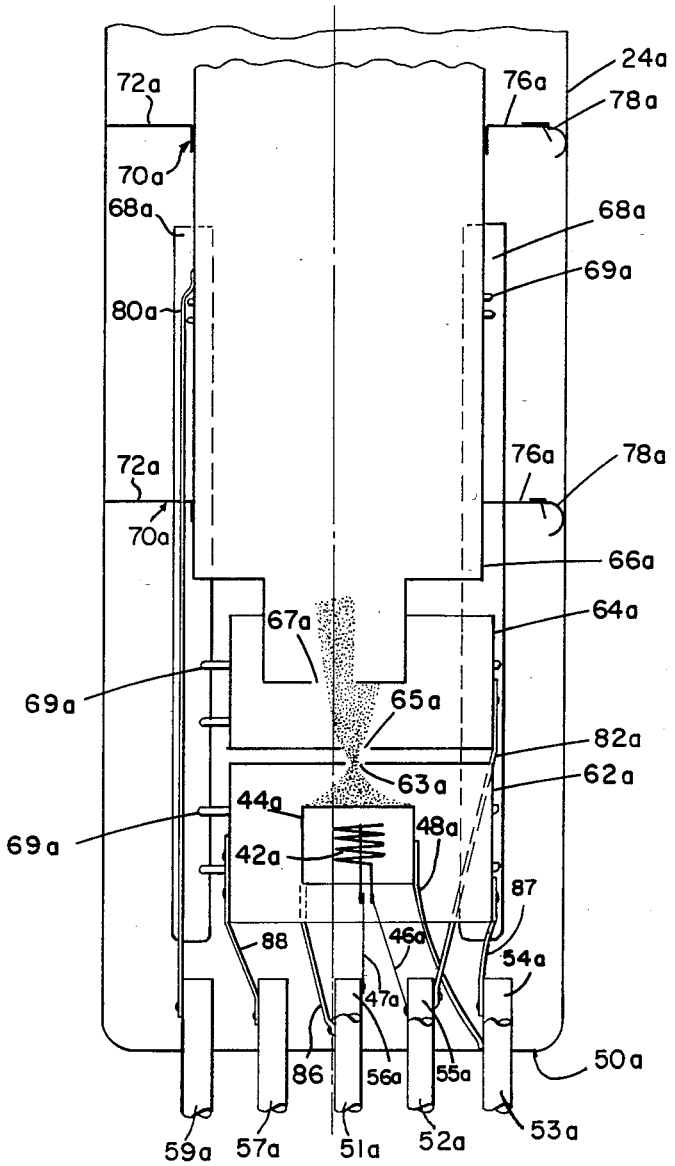
FIG. 6 PRIOR ART
FIG. 6 is a fragmentary schematic view, in axial section, illustrating undesired results of disadvantageous aspect shown in FIG. 5.

However, due to the softening of the glass in the sealing operation, it is difficult to maintain the stem press 42*a* on the axial centerline of neck-end portion 24*a*. Consequently, as shown in FIG. 6, the stem press 42*a* may move laterally off the centerline or may rotate thereby transmitting through the terminal pins 51*a*, 54*a* and 57*a* and attached rigid conductors 86, 87 and 88 a laterally directed pressure to the adjacent end portion of sub-assembly 60*a*. Since the third beam-forming electrode 66*a* is transversely supported by the respective axially spaced rings 70*a*, the first and second beam-forming electrodes 62*a* and 64*a* may be moved laterally relative to the third beamforming electrode 66*a*, and the apertures 63*a* and 65*a* drawn out of alignment with the aperture 67*a*. Accordingly, an electron beam formed in the beam-forming sub-assembly 60*a* may have a portion of its cross-section intercepted by the wall portion of electrode 66*a* encircling the aperture 67*a* and the resulting beam may be focussed on an elliptically-shaped area, rather than the desired symmetrically circular-shaped area, of imaging screen layer 32*a*.

Referring again to FIGS. 1 and 2, the electron gun 40 of tube 10 has the first and second beam-forming electrodes 62 and 64 electrically connected to respective terminal pins 54 and 52 through flexible wire conductors 84 and 82, respectively. On the other hand, the third beam-forming electrode 66 of gun 40 is electrically connected to terminal pin 59 through a hollow tubular conductor 90 which has sufficient rigidity for supporting the entire sub-assembly 60 in axial spaced relationship with the stem press 50. The tubular conductor 90 is made of suitable material, such as nonmagnetic stainless steel or nickel alloy, for example, and has a plurality of axially spaced bendable portions comprising transversely extending crimps, 91 and 92, respectively. The crimps 91 and 92 may be disposed substantially parallel with respect to one another to provide sufficient stiffness for resisting torsional stresses which tend to rotate the stem press 42. Crimp 91 may be disposed adjacent a flattened end portion of conductor 90 which is attached, as by welding, for example, to the outer cylindrical surface of electrode 66. The crimp 92 may be disposed adjacent an end portion of conductor 90 having an inner diameter slightly larger than the outer diameter of terminal pin 59 whereby this end portion of conductor 90 may slide over the inner end of terminal pin 59 and be attached, as by welding, for example, to the terminal pin 59.

Figure 3:
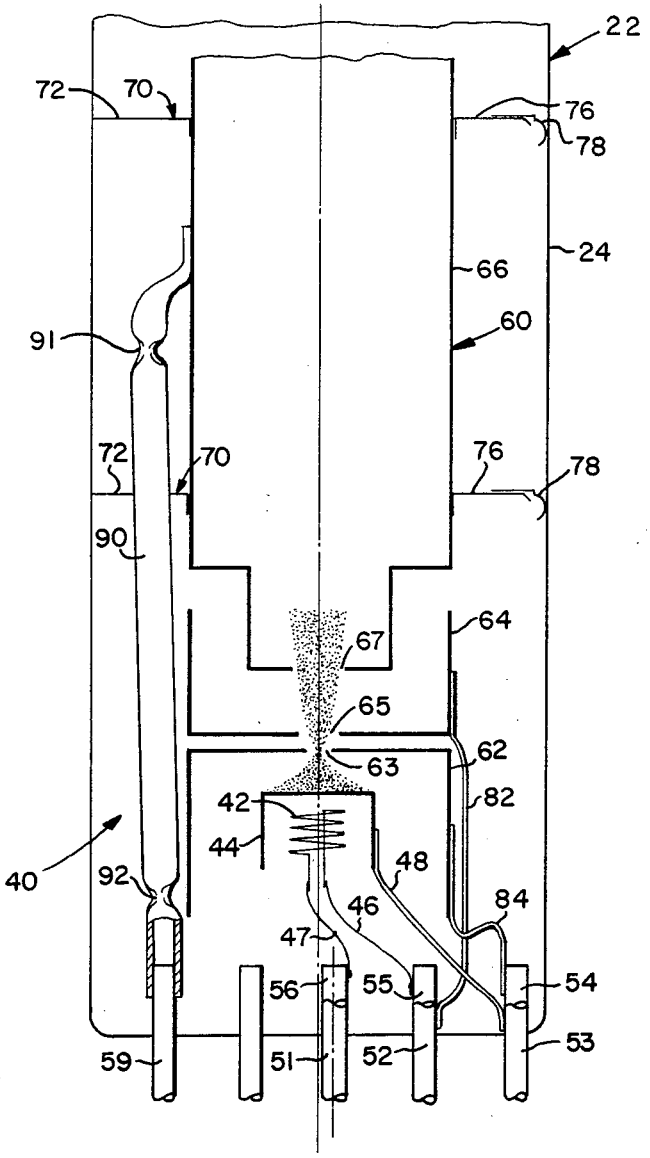
FIG. 3 is a fragmentary schematic view, in axial section, of the neck-end portion of the tube shown in FIG. 1 illustrating an advantageous aspect of the invention.

Consequently, as shown in FIG. 3, if the stem press 42 moves laterally off the centerline of neck-end portion 24 during the subsequent sealing operation, the conductors 82 and 84 flex to permit lateral movement of the stem press 42 without transmitting a corresponding laterally directed pressure to the adjacent end portion of sub-assembly 60. The conductor 90 having an end portion fixedly attached to terminal pin 59 in stem press 50 also flexes or bends yieldingly at one or both of the crimped portions, 91 and 92, respectively, to permit lateral movement of the stem press 50 without transmitting a corresponding laterally directed pressure to the end portion of sub-assembly 60 remote from the stem press. Also, the large moment of inertia and low mass of tubular conductor 90 are particularly advantageous for providing the strength and stiffness required when the gun 40 is inserted into neck-end portion 24 and for supporting the sub-assembly 60 axially within the neck-end portion after sealing the stem press 42 to neck-end portion 24. In contrast to a similar wire conductor, the low mass of tubular conductor 90 does not load and distort alignment of the third beam-forming electrode 66 when the tube 20 is subjected to mechanical shock or vibration.

Figure 7:
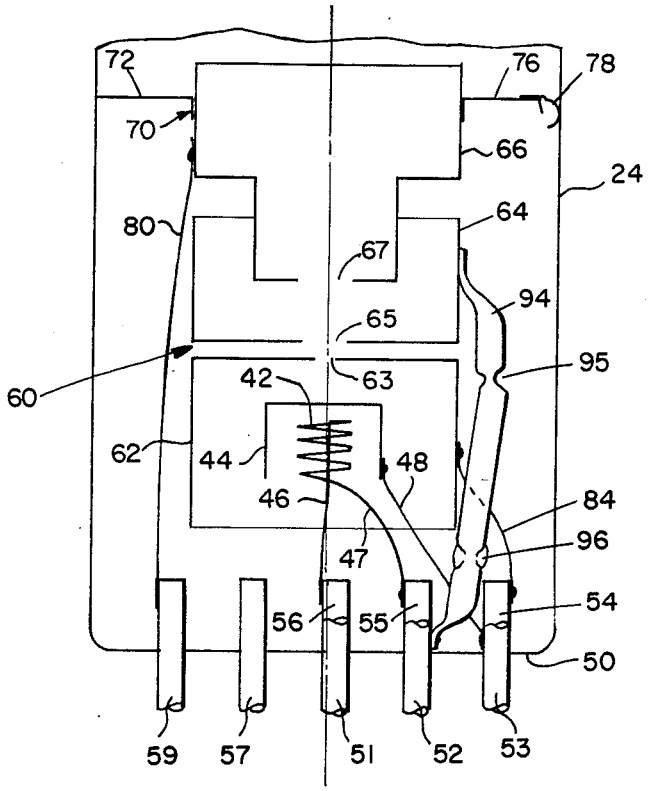
FIGS. 7 and 8 are fragmentary schematic views, in axial section, similar to FIG. 3 but showing respective alternative embodiments of the invention.

As shown in FIG. 7, the tubular conductor need not be attached to third beam-forming electrode 66 but, alternatively, may comprise a relatively shorter tubular conductor 94 attached to the second beam-forming electrode 64. Thus, the conductor 94 would electrically connect the second beam-forming electrode 64 to its respective terminal pin 52 and have sufficient rigidity for supporting the entire sub-assembly 60 in axial spaced relationship with the stem press 50. Accordingly, the first beam-forming electrode 62 may be connected to its respective terminal pin 53 through the flexible wire conductor 84 and the third beam-forming electrode 66 may be connected to its respective terminal pin 59 through a flexible wire conductor 80. Also, the conductor 94 may be provided with two axially spaced transverse crimps 95 and 96 which may be disposed substantially orthogonal with respect to one another, rather than being disposed parallel with respect to one another as shown in FIGS. 1 and 3, to provide sufficient versatility in developing practical configurations of this device.

Figure 8:
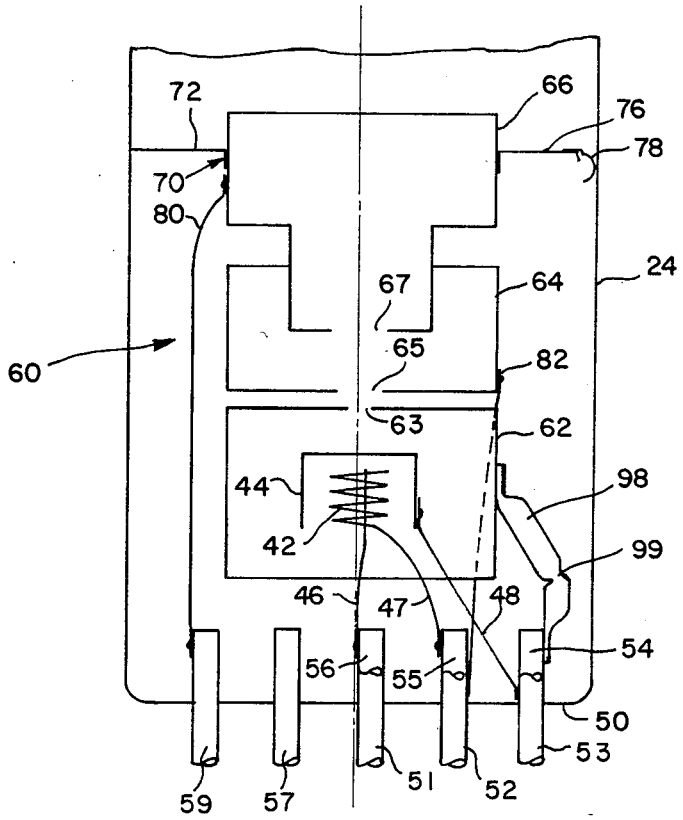

As shown in FIG. 8, in a second alternative embodiment of the gun 40 the second and third beam-forming electrodes 64 and 66 may be electrically connected to their respective terminal pins 52 and 59 through flexible wire conductors 84 and 80, respectively. The first beam-forming electrode 62 may be electrically connected to terminal pin 54 through a hollow tubular conductor 98 having in its midportion a transverse crimp 99 which is oriented to compensate for lateral movement of the stem press 42 during sealing. Thus, when the stem press 42 undergoes lateral movement, the conductors 80 and 82 flex and the conductor 98 bends at the crimp 99 thereby permitting said lateral movement of stem press 42 to take place without a corresponding laterally directed pressure being transmitted to attached portions of the sub-assembly 60.

Accordingly, each one of the electrodes 62, 64 and 66 in the sub-assembly may be electrically connected to respective terminal pins in the stem press 50 through respective tubular conductors having therein at least one transverse crimped portion. Furthermore, some of these tubular conductors may be provided with three or more transverse crimped portions; and these crimped portions may be angularly oriented in any manner desired with respect to one another. Also, the hollow tubular conductors may have respective cross-sectional configurations other than circular, such as triangular or rectangular, for examples.

Thus, there has been disclosed herein an electron gun having a sub-assembly of beam-forming electrodes electrically connected to respective terminals in a supporting member, at least one of the electrodes being electrically connected to its respective terminal through a hollow tubular conductor. The hollow tubular conductor has sufficient rigidity for axially and anti-rotationally supporting the sub-assembly and has a flexible portion transversely bendable for permitting lateral movement of the supporting member relative to the attached electrode of the sub-assembly.

From the foregoing, it will be apparent that all of the objectives of this invention have been achieved by the structures and materials described herein. It also will be apparent, however, that various changes may be made by those skilled in the art without departing from the spirit of the invention as expressed in the appended claims. It is to be understood, therefore, that all matter shown and described herein is to be interpreted in an illustrative rather than in a restrictive sense.

What is claimed is:

1. An electron device comprising:

a support member;

an electrode spaced from said support member; and an electrical conductor having respective securable portions secured to said support member and said electrode and having between said securable portions an integral hollow tubular portion including transverse yieldable means for supporting said electrode in spaced relationship with said support member axially of said tubular portion and for permitting transverse motion of one of said securable portions relative to the other one of said securable portions.

2. An electron device as set forth in claim 1 wherein said transverse yieldable means includes reduced cross-sectional means for permitting bending of said hollow tubular portion in response to a laterally directed pressure exerted on said one of the securable portions.

3. An electron device as set forth in claim 2 wherein said reduced cross-sectional means includes a transversely crimped region in said hollow tubular portion.

4. An electron gun comprising:

a support member;

electrode means disposed in spaced relationship with said support member for producing a beam of electrons; and an electrical conductor having respective securable portions secured to said support member and said electrode means and having between said securable portions an integral hollow tubular portion including transverse yieldable means for supporting said electrode means in spaced relationship with said support member and for permitting transverse motion of said securable portions relative to one another.

5. An electron gun as set forth in claim 4 wherein said support member comprises a dielectric body having projecting therefrom a plurality of spaced electrical terminals.

6. An electron gun as set forth in claim 5 wherein said dielectric body comprises a disc having extending axially therefrom said plurality of spaced electrical terminals, and said electrode means comprises an axially aligned series of mutually spaced electrodes insulatingly connected to one another in a sub-assembly and having an end portion axially spaced from said electrical terminals.

7. An electron gun as set forth in claim 6 wherein said electrical conductor comprises a hollow tubular conductor having respective end portions attached to one of said electrodes of the sub-assembly and to one of said electrical terminals for supporting said sub-assembly in axial spaced relationship with said electrical terminals and for electrically connecting said one of the electrodes to said one of the electrical terminals.

8. An electron gun as set forth in claim 7 wherein said hollow tubular conductor has between said respective end portions at least one transversely crimped region for permitting transverse movement of one of said end portions of the conductor relative to said other one of said end portions of the conductor.

9. An electron tube comprising:

an envelope having an electrode supporting portion and an adjacent portion;

electrode means disposed within said envelope in spaced relationship with said electrode supporting portion thereof for producing a stream of electrons; and an electrical conductor having respective securable portions secured to said electrode means and to said electrode supporting portion of the envelope and having between said securable portions integral hollow tubular means for supporting said electrode means in spaced relationship with said electrode supporting portion of the envelope and for permitting transverse motion of said secured portions relative to one another.

10. An electron tube as set forth in claim 9 wherein said electrode supporting portion of the envelope is sealably connected to said adjacent portion thereof.

11. An electron tube as set forth in claim 10 wherein said electrode supporting portion of the envelope includes electrical terminal means for electrically connecting said electrode means externally of the envelope.

12. An electron tube as set forth in claim 10 wherein said electrode means comprises an aligned array of mutually spaced electrodes insulatingly connected to one another in a sub-assembly, one of said securable portions of the electrical conductor being secured to one of said electrodes of the array for supporting said sub-assembly in spaced relationship with said electrode supporting portion of the envelope.

* * * * *